US006443560B1

(12) United States Patent
Okano et al.

(10) Patent No.: US 6,443,560 B1
(45) Date of Patent: Sep. 3, 2002

(54) RECORDING HEAD AND INKJET RECORDING DEVICE HAVING SEPARATELY ARRANGED INK CHAMBERS AND INK DISCHARGE UNIT

(75) Inventors: Mamoru Okano; Yoshinobu Fukano; Seiji Yonekura, all of Hitachi; Tatsuo Igawa, Ibaraki; Kazuhito Masuda, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/654,890

(22) Filed: Sep. 5, 2000

(30) Foreign Application Priority Data

Feb. 7, 2000 (JP) ..... 2000-034313

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 6,062,136 A * 5/2000 Bolza-Schunemann ..... 101/183
6,117,698 A * 9/2000 Atobe et al. ..... 347/55

FOREIGN PATENT DOCUMENTS

| | | | |
|---|---|---|---|
| EP | 0703080 | * 3/1996 | ..... 347/55 |
| EP | 0882591 | 12/1998 | |
| EP | 0900658 | 3/1999 | |
| JP | 61283546 | 12/1986 | |
| JP | 09001824 | 1/1997 | |
| JP | 10044432 | 2/1998 | |
| JP | 10138490 | 5/1998 | |
| JP | 10244690 | 12/1998 | |
| JP | 10337872 | 12/1998 | |
| JP | 11058778 | 6/1999 | |

OTHER PUBLICATIONS

Japanese Patent national Publication of translated Version No. 97/27058.
Japanese Patent Unexamined Publication No. 11–10911.

* cited by examiner

*Primary Examiner*—Raquel Yvette Gordon
(74) *Attorney, Agent, or Firm*—Antonelli, Terry, Stout & Kraus, LLP

(57) ABSTRACT

An ink jet recording apparatus capable of obtaining a highly precise image for stabilizing an amount of ink to be flied onto a recording medium by supplying and recovering the ink, in an ink discharge unit within the recording head, due to a difference in height of positions where two ink chambers within the ink discharge unit are arranged.

15 Claims, 11 Drawing Sheets

(a) RECORDING ELECTRODE (b) MIGRATION ELECTRODE

RECORDING HEAD AND INKJET RECORDING DEVICE HAVING SEPARATELY ARRANGED INK CHAMBERS AND INK DISCHARGE UNIT

FIELD OF THE INVENTION

The present invention relates to a recording head for discharging ink comprising a coloring agent dispersed in solvent to thereby record on a recording medium, and an ink jet recording apparatus using the recording head.

BACKGROUND OF THE INVENTION

Conventionally, an ink jet recording apparatus, which discharges a small quantity of ink droplets through a minute discharge port to cause the ink droplets to adhere onto a recording medium for printing an image, has been configured by conducting ink to each discharge port from an ink tank, and imparting kinetic energy to the ink to thereby cause ink droplets to be discharged through the discharge ports and to adhere onto the recording medium for forming dots.

As one of driving methods to impart kinetic energy to the ink, there is a system (electrostatic recording system) in which voltage is applied between a recording electrode and a common electrode, with which a recording medium comes into contact, to cause ink to be discharged by means of an electrostatic force. This system has long attracted attention as a method to realize a highly precise ink jet printer because an amount of ink to be discharged onto the recording medium can be controlled by pulse width modulating voltage to be applied to the recording electrode.

As an example of such a system, there is described, in WO97/27058 specification, a method in which ink comprising a coloring agent dispersed in a low density in solvent is supplied to grooves, and voltage is applied to a recording electrode provided on the surfaces of walls of the grooves to condense the coloring agent with charge by an electric field for discharging the ink condensed toward the recording medium from the recording electrode.

Also, in JP-A-11-10911 specification, there has been described an ink circulation method in a recording apparatus having the above described system. In the present specification, it has been described that it is possible to prevent pressure fluctuation in the ink circulation path by the provision of air chambers at positions before ink is supplied to an ink flying unit and after the ink is recovered from the ink flying unit.

The electrostatic recording system disclosed in the above described specification is a method for discharging ink obtained by concentrating the coloring agent component onto the recording medium for recording an image by applying bias voltage to the recording electrode while the ink is being circulated, gathering the ink obtained by concentrating the coloring agent component to the tip end of the recording electrode, and superimposedly applying the pulse voltage to the recording electrode in the state. Also, since there are not present small holes in the ink discharge unit in the present recording system, it is difficult to create clogging due to ink. For the reason, even if a long recording head having a number of recording electrodes of several thousands is manufactured, it is difficult to cause defective points where the ink does not fly, and therefore, this is an advantageous recording method to realize an ink jet recording apparatus having a long recording head. Since the recording apparatus having the long recording head is capable of recording many dots at the same time, this is characterized by being able to perform high-speed printing. In order to actually realize the long recording head, it is necessary that all of a multiplicity of ink discharge units is manufactured without defects, and that all the ink discharge units have the same printing characteristics during printing. For this end, it becomes important that the multiplicity of recording electrodes and ink flow paths are the same in shape, and that the recording head can be simply configured at low price.

SUMMARY OF THE INVENTION

According to the present invention, an ink jet recording apparatus having a better electrostatic recording system than the above described prior art has been devised, and one of objects of the present invention is to provide a small-sized low-priced recording head.

Another object is to provide a recording head capable of recording a high-quality, highly precise image at high speed and an ink jet recording apparatus using the same.

That is, according to an embodiment of the present invention, the configuration is arranged such that there are provided a first ink chamber and a second ink chamber, each containing ink comprising the coloring agent dispersed in solvent and an ink discharge unit for discharging the ink, and that the first ink chamber is arranged above the ink discharge unit, and the second ink chamber is arranged below the ink discharge unit.

Also, the configuration is arranged such that the ink flows from the first ink chamber to the second chamber due to differences in height of the positions whereat the first ink chamber, the ink discharge unit and the second ink chamber are arranged.

Also, the configuration is arranged such that an ink flow rate adjusting unit is provided between the first ink chamber and the ink discharge unit, and between the ink discharge unit and the second ink chamber respectively.

Also, the configuration is arranged such that a minimum value S1 of the sectional area of the ink flow path upstream of the recording electrode, a sectional area S2 of the ink flow path at the tip end of the recording electrode and a minimum value S3 of the sectional area of the ink flow path downstream of the recording electrode satisfy relation of S3>S1>S2.

DETAILED DESCRIPTION OF THE INVENTION

Figure 7:
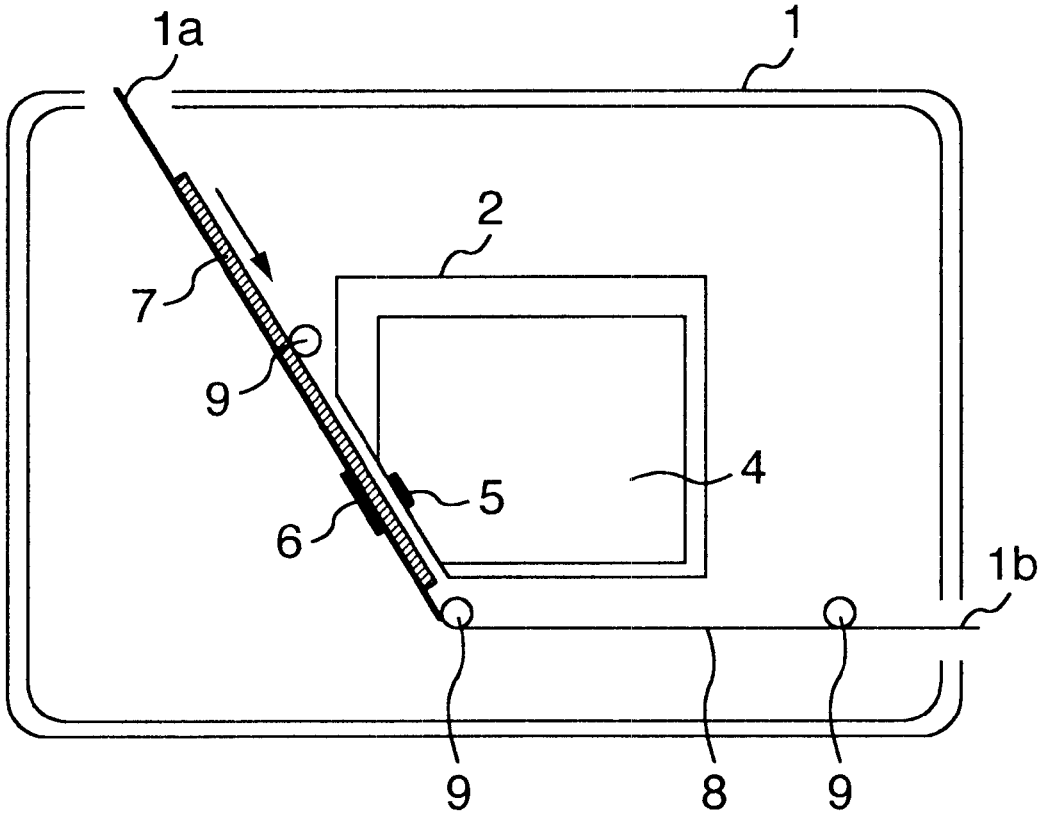
FIG. 7 is a view showing an embodiment of an ink jet recording apparatus according to the present invention.

FIG. 7 shows an embodiment of an ink jet recording apparatus according to the present invention.

Within a housing 1 for the ink jet recording apparatus, there are provided: a common electrode 6 grounded; a recording head 2, whose ink discharge port is arranged to be turned toward the common electrode 6; power supply for generating recording voltage pulse width modulated in response to an image signal from a controller built in for controlling the entire apparatus; bias power supply (not shown); and a recording medium conveying device for passing a recording medium 7 through between the common electrode 6 and the recording head 2.

The details of each portion are as follows.

Within the recording head 2, there are accommodated an ink discharge unit 5, in which a plurality of recording electrodes are arranged in lines in a direction that crosses a recording medium conveying path 8 provided such that the recording medium 7 can be smoothly conveyed without being curved extremely, and an ink circulation device 4 for supplying the ink to the ink discharge unit 5 and recovering.

In this respect, although FIG. 7 shows a recording head for one color, in an ink jet recording apparatus capable of color printing, there is arranged a recording head 2 for each color of at least cyan, magenta, yellow and black colors respectively.

The recording medium conveying device is configured by: the recording medium conveying path 8 provided from a recording medium insertion port 1*a* arranged in the upper part of the housing 1 to a recording medium exhaust port 1*b* arranged in the lower part of the housing 1 through a recording position whereat the recording head 2 is arranged; a pick roller (not shown) for guiding the recording medium 7 inserted through the recording medium insertion port 1*a* into the recording medium conveying path 8; a plurality of feed rollers 9 which are in contact with the conveying surface of the recording medium conveying path on both sides with predetermined pressure; a motor (not shown) for rotating each roller in accordance with an instruction from the controller for controlling the entire apparatus, or the like.

As ink used in the present recording apparatus, there can be used ink obtained by dispersing the coloring agent, together with a charge controlling agent, in petroleum solvent such as, for example, isoparaffin having as low viscosity as 1 to about 10 mPa·s. In this respect, the ink circulation method and the configuration of the ink discharge unit 5 will be described in detail later.

First, the description will be made of the ink circulation device 4.

Figure 1:
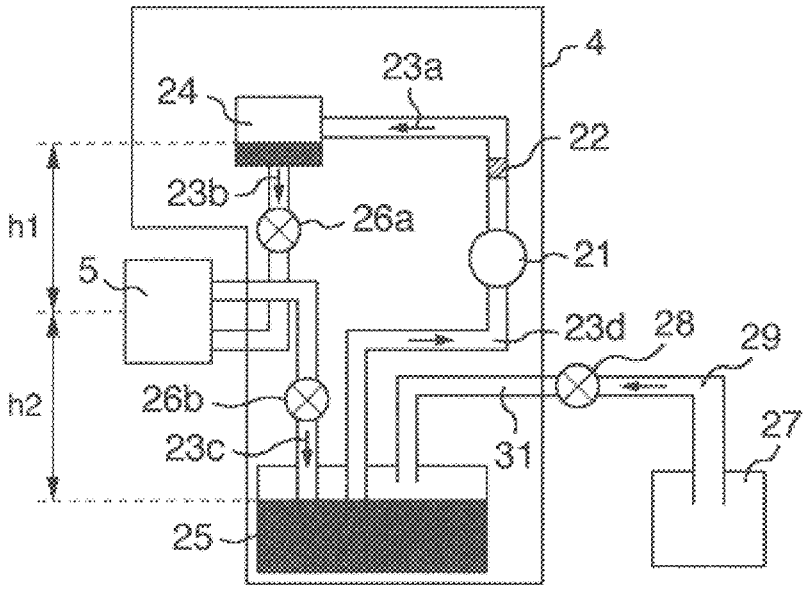
FIG. 1 is a view showing an embodiment of a recording head in an ink jet recording apparatus according to the present invention.

FIG. 1 is a view for explaining a configuring example of the ink circulation device 4. The ink circulation device 4 is provided with: an ink flow rate adjusting chamber 24 in a first ink chamber for adjusting the ink flow rate to be supplied to the ink discharge unit 5; an ink recovery container 25 in a second ink chamber for storing ink which is circulating; piping 23*a*, 23*b*, 23*c* and 23*d* for connecting between each of these portions; a filter 22 for removing any impure ingredient in the ink; magnet valves 26*a* and 26*b* in an ink flow rate adjusting unit for controlling the flow of the ink; and a pump 21 to be driven by the control of the controller.

The ink circulation device 4 configured by these portions is divided into two systems: an ink supply system for supplying ink to the ink discharge unit 5, and an ink recovery system for recovering the ink from the ink discharge unit 5.

Figure 17:
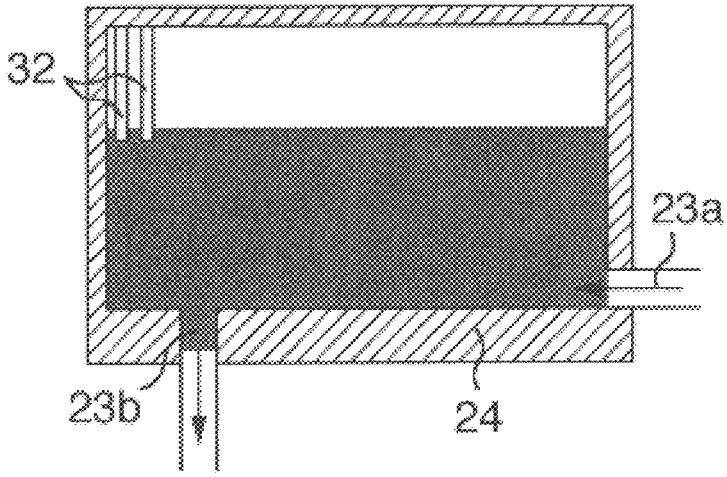
FIG. 17 is a view showing an embodiment of an ink flow rate adjusting chamber in an ink circulation device according to the present invention.

In the ink supply system, ink stored in the ink recovery container 25 is sucked up by a pump 21, and is fed into the ink flow rate adjusting chamber 24 via the filter 22. The ink stored in the ink flow rate adjusting chamber 24 is to naturally flow toward the ink discharge unit 5, in which a plurality of recording electrodes are arranged, by pressure based on potential energy to be determined by a difference h1 in height between the ink liquid level and the ink discharge unit 5. In order to prevent the ink liquid level within the ink flow rate adjusting chamber 24 from fluctuating when the ink is supplied through the piping 23*a* and is exhausted through the piping 23*b* as shown in FIG. 17, the ink flow rate adjusting chamber 24 is mounted with an ink liquid level detector 32 for detecting the ink liquid level in such a manner that its detection value is fed back to the controller. For this reason, the pump 21 is driven such that a deviation between a detection value by the ink liquid level detector 32 and a predetermined target value becomes small, and the amount of the ink within the ink flow rate adjusting chamber 24 is maintained almost constant.

On the other hand, in the ink recovery system, the ink, which passed through the ink discharge unit 5, is to naturally flow by means of a difference h2 in height between the ink discharge unit 5 and the ink recovery container 25. By means of the difference in height between the first and second ink chambers (ink flow rate adjusting chamber 24 and ink recovery container 25) provided above and below the ink discharge unit 5 without providing any pump or the like for supplying and recovering the ink as described above, a stable supply of the ink to the ink discharge unit 5 in the amount and a stable recovery thereof to the ink recovery container 25 are ensured, thereby the ink circulation device can be manufactured in small-size and at low price, and a stable flow of the ink can be ensured. Since the amount of flying ink is stabilized when the stable flow of the ink is obtained, any image unevenness due to variations in density does not occur in the printed image to stabilize the image quality. Therefore, an ink jet recording apparatus capable of recording a high quality image can be provided.

In this respect, in the present embodiment, since the ink is circulated only by the difference in height, it is necessary that the sizes of h1 and h2 are adjusted to be set to appropriate values. Those values depend upon the type of the ink to be used, the printing speed, the number of the recording electrodes, the inner diameter and length of the piping 23.

In order to prevent bubbles from remaining in the recording head 2 when air enters from the ink discharge unit 5, the position of piping for recovering the ink is set above the position of piping for supplying the ink to the ink discharge unit 5.

The description will be made of an example of an operation of the magnet-valves 26*a* and 26*b* in the ink flow rate adjusting unit.

While the present ink jet recording apparatus is not used for printing, the magnet-valves 26*a* and 26*b* are kept closed, and the ink is not circulated. Before printing is started, the magnet-valves 26*a* and 26*b* are opened at the same time, and are adjusted such that the amounts of circulated ink upstream of and downstream of the ink discharge unit 5 are equal to each other. If the amounts of circulated ink on the upstream side and on the downstream are different, the ink will leak from the ink discharge unit 5, or air will enter the piping 23*b* or 23*c*. When air enters the piping 23*b* or 23*c*, the air entered causes a problem that it stops within the piping to stop the circulation of the ink. After the ink circulation is stabilized by the adjustment of the magnet-valves 26*a* and 26*b*, voltage is applied to the recording electrode to start the printing.

Even when the recording apparatus is stopped, the magnet-valves 26*a* and 26*b* are actuated at the same time to maintain the amounts of circulated ink upstream of and downstream of the ink discharge unit 5 to be equal to each other, and the amount of circulated ink will be gradually reduced. In this respect, as regards the magnet-valves 26, if magnet-valves, which become "closed" when the application of voltage is stopped, are used, it will be possible to prevent any ink leakage from the ink circulation device 4 even at abrupt service interruption.

In this respect, the adjustment of the ink flow rate at the time of supply and recovery of the ink can be also controlled by the condition in which the magnet-valves are opened and closed.

Since the ink is supplied and recovered only by means of the difference in height without using any pump or the like by the use of the ink circulation device 4 described above, it becomes possible to provide a small-sized, low priced recording head, and to provide stable ink circulation, and a recording head capable of recording a high-quality, highly precise image can be provided.

The ink circulation device 4 is provided within the recording head 2, and in addition thereto, within the recording apparatus, there exist a replenishing ink tank 27, a pump 28 and the piping 29 as members relating to the ink circulation. These will be described below.

When the image recording is continued, the total amount of the ink in circulation and the ink within the ink recovery container 25 will be reduced, and therefore, it becomes necessary to replenish the ink. Therefore, it is necessary to provide a mechanism to replenish the ink by detecting the amount of ink within the ink recovery container 25.

Figure 16:
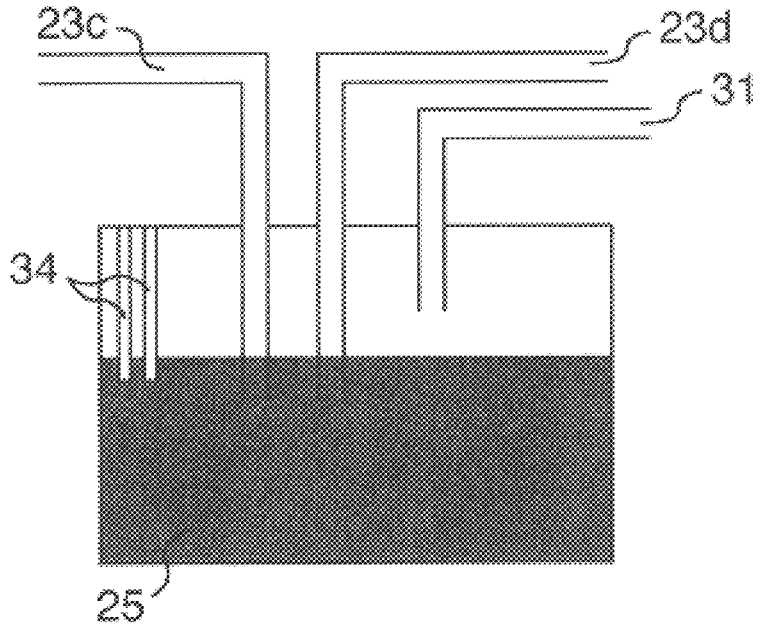
FIG. 16 is a view showing an embodiment of an ink recovery container in an ink circulation device according to the present invention.

Hereinafter, the description will be made with reference to FIG. 1, and FIG. 16 showing a sectional view for the ink recovery container 25 according to an embodiment.

The ink recovery container 25 is therein mounted with an ink level detector 34 for detecting the ink liquid level, and its detected value is fed back to the controller. If the amount of ink is insufficient, the ink will be supplied to the ink recovery container 25 from the replenishing ink tank 27 through the piping 29 and 31 by the pump 28. For this reason, an appropriate amount of ink will be always present in the ink circulation device 4.

In this respect, there is provided a connecting mechanism between the replenishing ink tank 27 for replenishing ink to the ink circulation device 4 and the ink circulation device 4, and the replenishing ink tank 27 is detachable from the ink circulation in device 4 and the recording head 2 so that it can be separated from the connecting mechanism and be easily replaced with a new ink tank even if the ink within the replenishing ink tank 27 is exhausted.

Further, there is provided an air removal mechanism around the connecting mechanism so as not to cause air to enter the ink circulation device when the ink is replenished. The provision of the air removal mechanism does not fluctuate the pressure within the ink recovery container 25, but enables stable ink circulation.

Next, with reference to FIGS. 2 to 6, the description will be made of an ink discharge unit 5 according to a configuring example.

Figure 2:
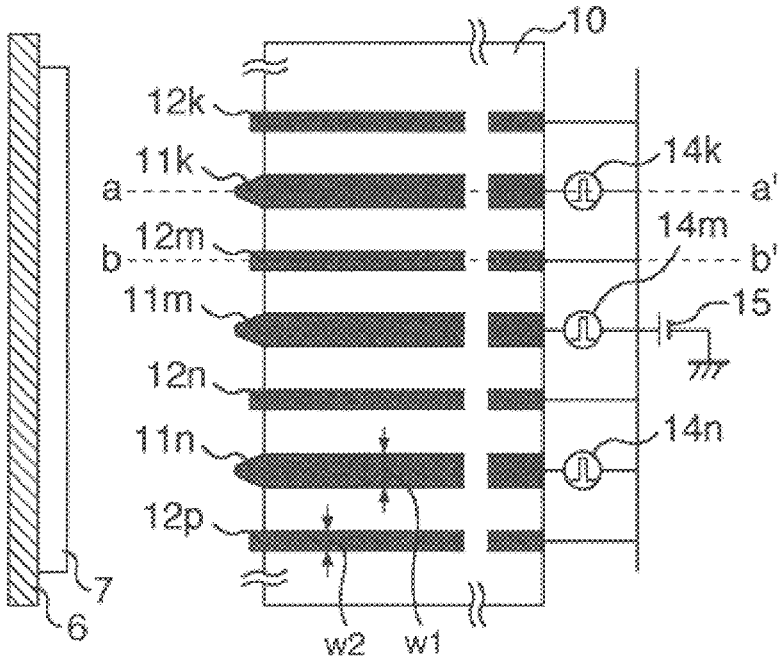
FIG. 2 is a view showing layout of recording electrodes and control electrodes in the recording head according to the present invention.
Figure 3:
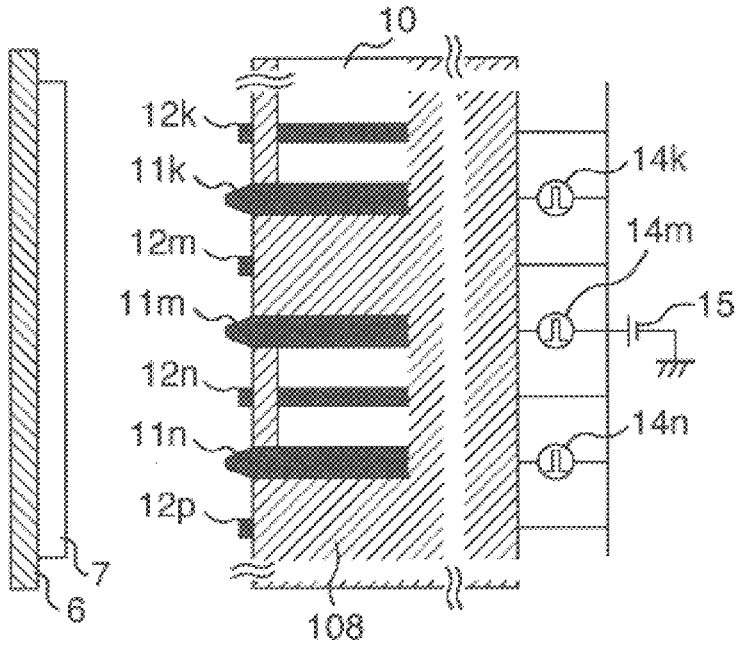
FIG. 3 is a view showing ink flow paths in the vicinity of the recording electrodes in the recording head according to the present invention.
Figure 4:
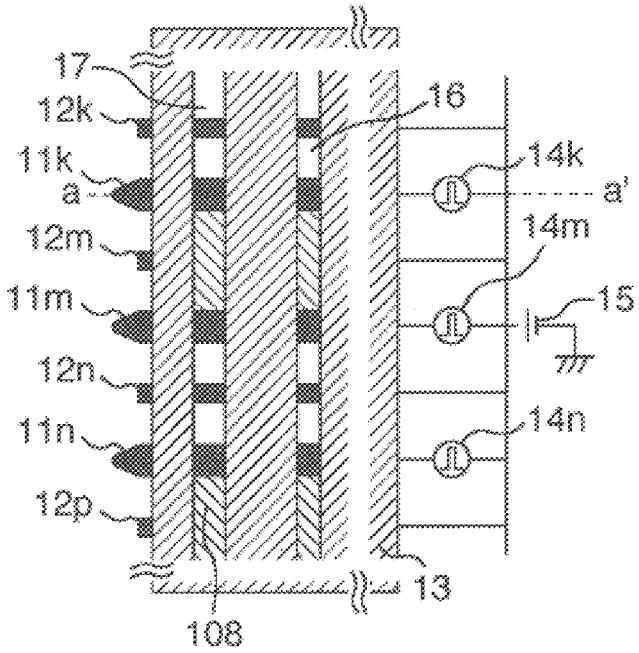
FIG. 4 is a view showing an ink supply port and a recovery port in the recording head according to the present invention.
Figure 5:
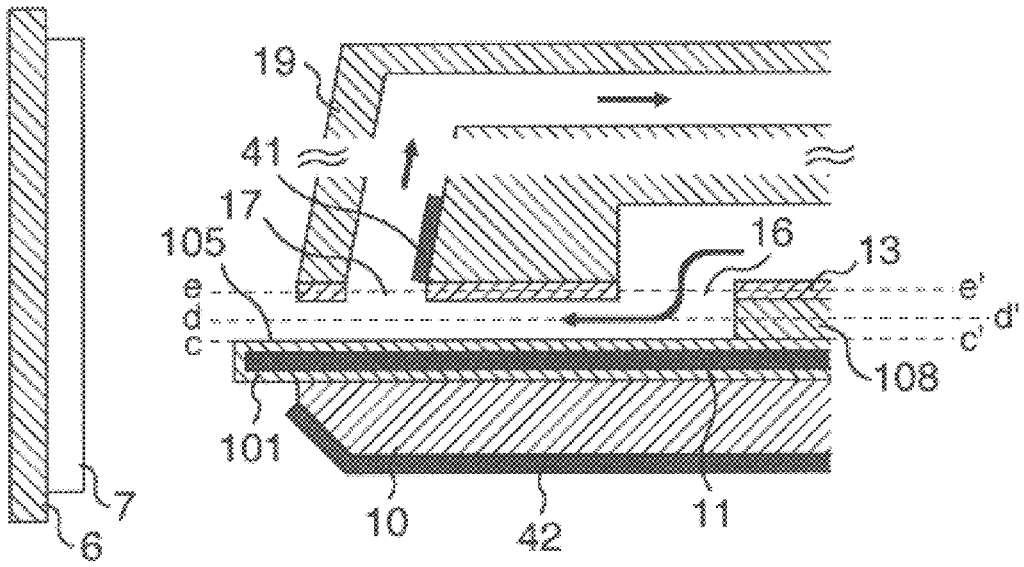
FIG. 5 is a sectional view showing an embodiment of an ink discharge unit in the recording head according to the present invention.
Figure 6:
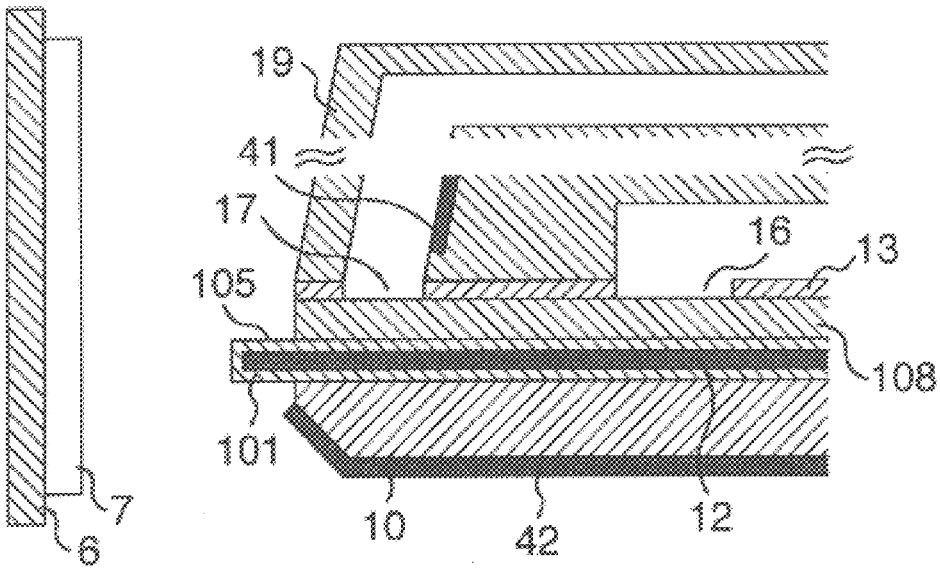
FIG. 6 is a sectional view showing the ink discharge unit at a different position from in FIG. 5.

FIG. 2 is a configuring view showing electrodes around the ink discharge unit 5 in an ink jet recording apparatus according to the present embodiment. FIG. 3 is a view showing a state in which a dielectric layer 108 for forming an ink flow path has been formed on top of the arrangement pattern of the recording electrodes 11 and the control electrodes 12 shown in FIG. 2. FIG. 4 is a view showing a state in which a dielectric layer 13 has been further formed on top of the state of FIG. 3. FIG. 5 is a view showing a state of a section (a–a' section) at the recording electrode 11 of the ink discharge unit 5 shown in FIG. 2. FIG. 6 is a view showing a state of a section (b–b' section) at the control electrode 12 shown in FIG. 2.

In the present embodiment, on a head substrate 10 made of an insulant having low dielectric constant such as glass, there are provided recording electrodes 11*k*, 11*m* and 11*n*, each having a protruded portion at its tip end, and control electrodes 12*k*, 12*m*, 12*n* and 12*p* provided so as to sandwich each recording electrode therebetween are arranged at predetermined intervals with their tip ends facing a common electrode 6 in a direction that crosses a recording medium conveying path 8. To the recording electrodes 11*k*, 11*m* and 11*n*, wiring is made such that voltage based on the pulse power supply 14*k*, 14*m* and 14*n* is superimposedly applied to the voltage based on bias power supply 15. As the wiring, the pulse power supply 14*k*, 14*m* and 14*n* is connected to each of the recording electrodes 11*k*, 11*m* and 11*n* respectively, and one common bias power supply 15 is connected to those pulse power supply 14*k*, 14*m* and 14*n*. Also, to the control electrodes 12*k*, 12*m*, 12*n* and 12*p*, wiring is made such that voltage can be directly applied to each of them from one bias power supply 15.

The width w1 of the recording electrode 11 shown in FIG. 2 is 80 to about 150 $\mu$m, and the tip end of the recording electrode 11 protrudes 100 to about 200 ìm from the edge of the head substrate 10 on the common electrode 6 side. If the width of the recording electrode 11 is too narrow, the resistance to the ink flow path will become high to reduce the amount of supplied ink to the tip end of the recording electrode 11. Conversely, if the width of the recording electrode 11 is too broad, the flow rate of the ink will become too high, and the ink flows into the ink jet recording apparatus through the tip end of the recording electrode 11 to contaminate. If the amount of protrusion of the recording electrode 11 is too small, the edge of the head substrate 10 will serve as an ink flying point so that the ink flies to improper positions. Conversely if the amount of protrusion of the recording electrode 11 is too large, the amount of ink to be fed to the tip end of the recording electrode 11 will be reduced not to fly any ink.

The width w2 of the control electrode 12 is 20 to about 50 ìm. Fixed voltage is always applied to the control electrode 12 in advance, and the control electrode 12 is installed in order to prevent the aberration in the deposited position of the ink on the recording medium 7 by making, proper, the electric field distribution at the tip end of the recording electrode 11 when the ink is discharged. It is necessary that the tip end of the control electrode 11 protrudes 20 to 50 $\mu$m from the edge of the head substrate 10. If the amount of protursion of the control electrode 12 is too small, the electric field at the tip end of the control electrode 12 will be relieved to reduce the effect expected. Conversely if the amount of protrusion of the control electrode 12 is too large, the electric field at the tip end of the recording electrode 11 will be weakened to reduce the amount of flied ink.

Next, the description will be made of FIGS. 3 and 4.

The dielectric layer 108 is a member provided in order to form an ink flow path on top of the arrangement pattern of the recording electrode 11 and the control electrode 12, and the dielectric layer 13 is a member provided to make a lid for the ink flow path. The thickness of the dielectric layer 108 is about 50 to 120 $\mu$m, and the thickness of the dielectric layer 13 is about 20 $\mu$m. If the thickness of the dielectric layer 108 is thin, the resistance to the ink flow path will become high to cause the ink not to flow, and if thick conversely, the ink will leak at the tip end portion of the recording electrode 11, and therefore, in is set to the above described range. In this respect, since the thickness of the dielectric layer 13 has preferably such strength as to serve as the lid for the ink flow path, and is such a thickness as to be easily etched, it can be set to the above described value or so.

The ink enters through an ink introducing port 16 shown in FIG. 4, flows through an ink flow path constituted by the dielectric layer 13 as the lid, a surface including two recording electrodes and a control electrode interposed therebetween (for example, recording electrodes 11*k* and 11*m,* control electrode 12*m*) as the bottom surface, and the dielectric layer 108 as the wall surface, and is discharged through an of the tip end of the recording electrode 13 are individualized as shown in FIG. 3. When such configuration is adopted, the ink is introduced from the ink introducing port 16 to the ink flow paths by the capillary tube phenomenon, and therefore, the ink is prone to be supplied to the tip end of the recording electrode 11. Also, since the ink is not directly connected between the tip ends of the recording electrode 11, potential to be applied to the recording electrode does not propagate to the adjacent recording electrode (not affected by cross talk from the adjacent recording electrode), but there is no possibility that unnecessary ink droplets fly.

Next, the description will be made of a method for applying voltage to the recording electrode 11 and the control electrode 12.

When the interval between the recording electrode 11 and the common electrode 6 is 1 mm, to the individual recording electrodes 11, which are present in the ink discharge unit 5 of the recording head 2, bias voltage of 1.5 to about 2 kV is applied by the bias power supply 15, and further pulse voltage of about 0.5 kV is superimposed on the bias voltage in response to the recording signal by pulse power supply 14 for applying. By applying bias voltage to the recording electrode 11 during printing, the coloring agent component in the ink, which is circulating within the ink circulation device, gathers to the tip end of the recording electrode 11. Thus, when pulse voltage is applied, the ink flies from the tip end of the recording electrode 11. The ink, which decreases by flying onto the recording medium, is replenished from the replenishing ink tank 27 as described above.

Voltage with magnitude of about the bias voltage is always kept applied to the control electrode 12, and the electric field destribution at the tip end of the recording electrode 11 is stabilized to thereby prevent aberration in the deposited position of the ink on the recording medium during printing.

Next, with reference to FIGS. 5 and 6, the description will be made of how the ink flows.

On the upper side of the dielectric layer 13, which services as a lid of the ink flow path, there is provided a cover 19, on which an ink circulation path has been formed, to thereby supply and recover the ink.

The recording electrode 11 extends from a voltage supply unit (not shown) at the base (ink interduction side), and is one of walls of the ink flow path together with the dielectric layer 108 and the upper dielectric layer 13. The ink is, as shown in FIG. 5, supplied from an ink introducing port 16 along the arrow, and is recovered from an ink recovery port 17. The shapes of the ink introducing port 16 and the ink recovery port 17 are slit-shaped as shown in the d–d' section (FIG. 3). As described above with reference to FIG. 2, the tip end of the recording electrode 11 protrudes from the edge of the head substrate 10 on the common electrode 6 side. Since the ink is supplied on the recording electrode 11, the recording electrode 11 is configured by providing metal with thickness of about 1 $\mu$m on top of dielectric material 101 with thickness on about 20 $\mu$m in order to cause it to have strength for supporting the weight of the ink. The recording electrode 11 is covered with insulating protective coat 105. This is because in the case where the amount of supplied ink to the tip end of the recording electrode 11 decreases for some cause or other, the tip end of the recording electrode 11 is prevented from being damaged due to discharge because the recording electrode 11 is first prone to discharge.

Figure 12:
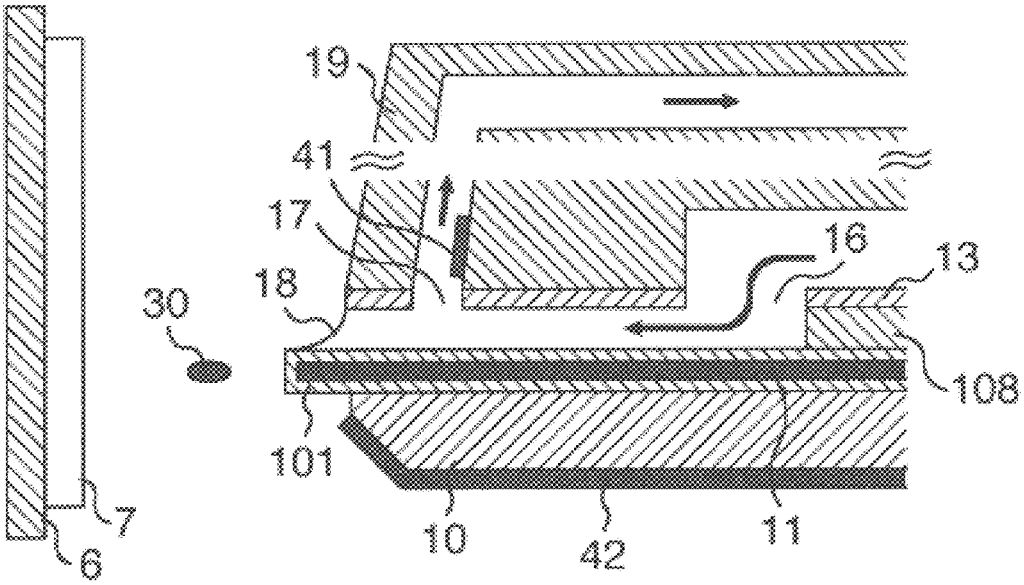
FIG. 12 is a view for explaining ink meniscus to be formed in the vicinity of the recording electrode in the recording head.
Figure 13:
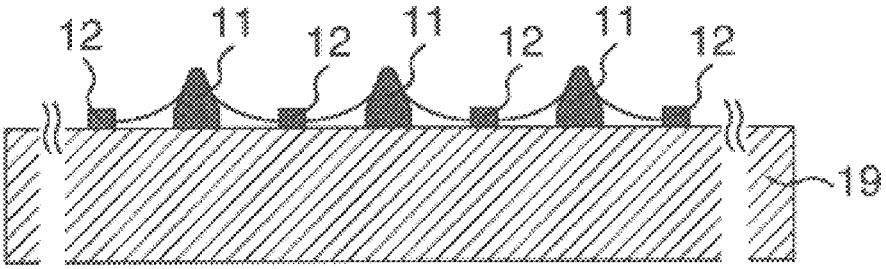
FIG. 13 is a view for explaining ink meniscus to be formed in the vicinity of the recording electrode in the recording head.

When the ink is supplied and recovered as described above, the curve-shaped ink liquid level (hereinafter, referred to as ink meniscus) due to surface tension of the ink is formed in the vicinity of the tip end of the recording electrode 11. FIG. 12 shows a state in which the ink meniscus 18 is formed on the same section as in FIG. 5, and FIG. 13 shows a state in which the ink meniscus 18 is formed as viewed from the upper surface of the recording head 2. The ink meniscus 18 is shaped so as to supply the ink to the tip end of the recording electrode, and when voltage obtained by superimposing the pulse voltage on the bias voltage is applied to the recording electrode 11, ink droplet 30 of an amount corresponding to duration, during which the pulse voltage has been applied, fly onto the recording medium 7.

In the case where the ink is supplied to the tip by the difference in height as in the case of the present embodiment, it is necessary to prevent the ink from leaking from the tip end portion of the recording electrode 11. For this end, it is necessary to appropriately set the sectional area of the ink flow path. Hereinafter, the description will be made of an embodiment of the setting method.

Figure 15:
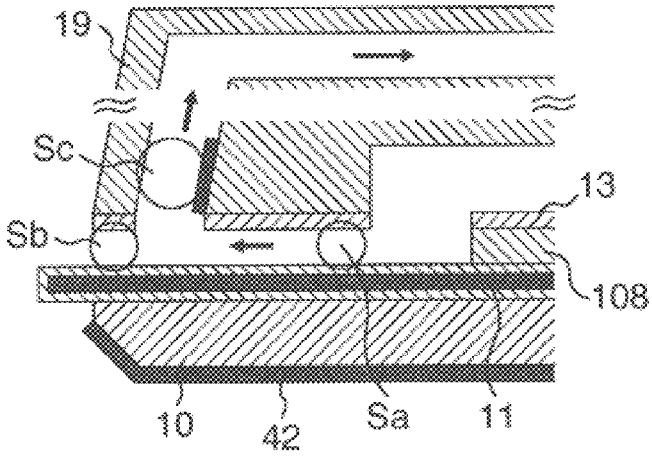
FIG. 15 is a view for explaining structure of a flow path within the ink discharge unit according to the present invention.

FIG. 15 is a view for explaining setting of the sectional area of the ink flow path. As described above, the ink flow paths are divided into three: the ink supply system within the ink circulation device 4; the ink recovery system; and within the ink discharge unit 5. The flow rate of the ink from the ink supply system to the ink recovery system is great, but the flow of ink at the tip end portion of the recording electrode 11 is only for the consumption of the ink, and the ink of an amount of consumed ink is replenished from the ink supply system. In order to prevent the ink from leaking from the tip end of the recording electrode 11, it is necessary to enhance the ink recovery capacity. Therefore, it is necessary that an area Sa of a portion having the minimum sectional area in the ink supply path within the ink discharge unit 5 is smaller than an area Sc of a portion having the minimum sectional area in the ink recovery path. Since air is taken in from the tip end of the recording electrode 11 when the ink recovery capacity is too high, it is necessary to increase the resistance to the flow path at the tip end portion of the recording electrode 11. Therefore, it is necessary that a sectional area Sb at the tip end portion of the recording electrode 11 is far smaller than the area Sa of a portion having the minimum sectional area in the ink supply paths. In other words, relation of Sc>Sa>Sb. Although the structure of the ink flow path has been described above, the dimensions of the flow path have been determined by taking this point in consideration.

Next, the description will be made of ink fixing to the tip end of the recording electrode, which is one of problems occurring during printing, and its solving method.

When the ink is flied while it is being circulated as described above, the ink, whose coloring agent has been condensed, always exists at the tip end of the recording electrode 11. If this state continues long, agglomerate of ink will gradually fix to the tip end of the recording electrode 11. When fixed substance adheres to the tip end of the recording electrode 11, electric field is concentrated on the edge of the fixed substance, and therefore, the ink flies from the fixed substance. Since the position, whereat the fixed substance adheres, cannot be specified, the position, whereat the ink flied is deposited on the recording medium, will deviate from a desired position. For the reason, there arises a problem that the quality of the printed image on the recording medium will be deteriorated. In order to prevent the ink from fixing to the tip end of the recording electrode 11, there is provided a migration electrode 41 at the starting position of an ink recovery path for recovering the ink, which has flowed, upward as shown in FIG. 12. In other words, the coloring agent, which has been charged by an electrostatic force to be generated by a difference in voltage to be applied to the recording electrode 11 and the migration electrode 41, is periodically conducted to the ink recovery path. Since the provision of the migration electrode 41 prevents the ink from fixing to the tip end of the recording electrode 11, the quality of the printed image on the recording medium will be always stabilized.

Figure 14:
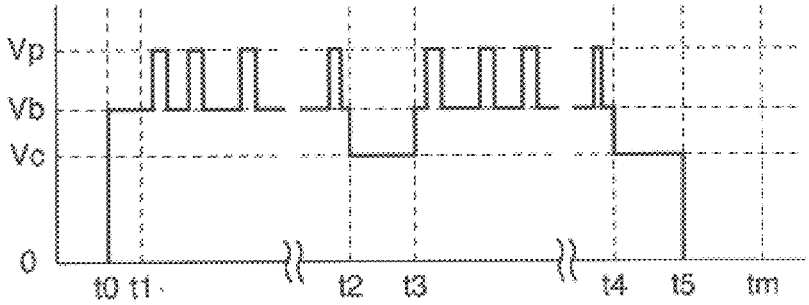
FIG. 14 is a time chart showing voltage to be applied to the recording electrode and a migration electrode according to the present invention.
Figure 14:
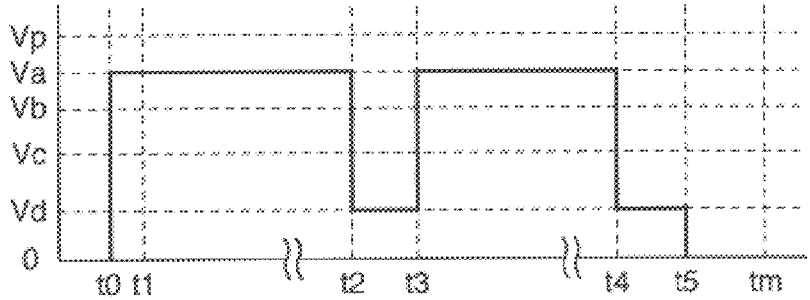

FIGS. 14A and 14B are time charts showing voltage to be applied to the recording electrode 11 and the migration electrode 41 respectively. In this respect, timing of voltage to be applied to the recording electrode 11 and the migration electrode 41 respectively must be synchronized during duration of t0 to tm.

Hereinafter, with reference to FIGS. 14A and 14B, the description will be made of an actual method for applying voltage.

After the circulation of ink is stabilized (t0), voltage of Vb is applied to the recording electrode 11, and Va is applied to the migration electrode 41. Va>Vb, and the coloring agent charged is prone to gather to the recording electrode 11. Va is set to be 100 to 200V higher than Vb. If the difference in voltage is low, the coloring agent in the ink will not gather, but if the difference in voltage is high conversely, the ink will fix to the tip end of the recording electrode 11.

During printing (t1 to t2), voltage of Vp with pulse voltage superimposed thereon is applied to the recording electrode 11. Since Vp is about 500V higher than Vb, Vp>Va. During the latter part of the printing (t2 to t3), voltage to be applied to the recording electrode 11 is assumed to be Vb, and voltage to be applied to the migration electrode 41 is assumed to be Vd. Setting to Vb>Vd returns the coloring agent component gathered to the tip end of the recording electrode 11 to the migration electrode 41 side, whereby any fixed substance is caused not to be produced at the tip end of the recording electrode 11. Even when the printing is terminated (t4 to t5), the coloring agent is recovered on the migration electrode 41 side from the tip end of the recording electrode 11 to thereby prevent any fixed substance from being produced.

When ink is supplied to the tip end of the recording electrode 11 for printing as described above, the ink may leak a little from the tip end of the recording electrode 11 because an ink recovery unit is located closer to the base side than the tip end of the recording electrode 11. Since the interior of the recording apparatus is contaminated when the ink leaks, the lower part of the head substrate 10 is mounted with an ink absorbing member 42 as shown in FIG. 12. The ink absorbing member 42 is preferably made of lightweight sponge, by which the ink is prone to be absorbed, or the like. The ink absorbed is conducted to a waste ink tank (not shown) through the ink absorbing member 42. In this respect, since they are consumption articles, the ink absorbing member 42 and the waste ink tank are arranged in such a manner as to be freely attached to or detached from the apparatus and are made replaceable. As regards the replacement time or the like, sensors are provided for each of them for notifying the user of the replacement time.

FIG. 6 is a sectional view (b–b' section of FIG. 1) in the control electrode 12 of the ink discharge unit 5 according to an embodiment.

The control electrode 12 having this section does not come into direct contact with the ink, but is located below the dielectric layer 108. According to the present embodiment, as shown in FIG. 3, the control electrodes 12 are to come into contact with the ink every one electrode, but the width of the ink flow path may be widened such that there are present three recording electrodes 11 and two control electrodes 12 within the same flow path. Since, however, the dielectric layer 13 is warped when the width of the ink flow path is widened, the width of the flow path must be set so as not to cause any warp.

In this respect, a recording head 2 according to the present invention performs recording while ink is being circulated, and if the amount of protrusion of the recording electrode 11 from the head substrate 10 is set within the above described range, the ink discharge direction will be able to be set in any directions between the horizontal direction and the vertical direction (90 degrees).

Figure 11:
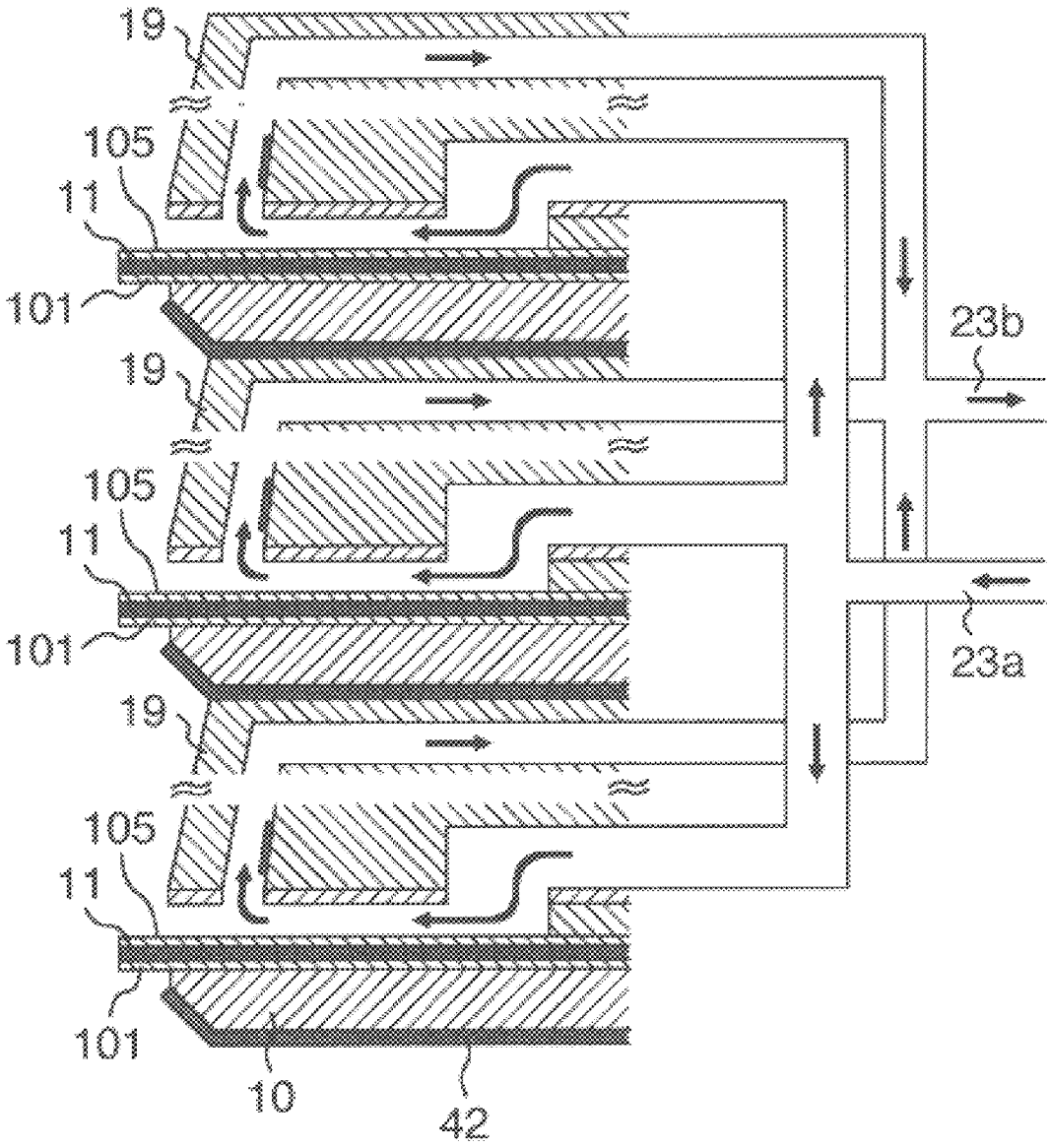
FIG. 11 is a sectional view showing another embodiment of an ink discharge unit in the recording head according to the present invention.

When the configuration of the recording head 2 shown in FIGS. 2 to 6 in the foregoing is adopted, the intervals between the recording electrodes 11 become as wide as about 250 $\mu$m, and therefore, in order to obtain a recording head for recording a highly precise image at high speed, it is necessary to pile up these ink discharge units 5 in several layers for arranging the recording electrodes 11 in a zigzag shape. FIG. 11 is a sectional view showing these ink discharge units 5 piled up in three layers. In an ink jet recording apparatus of a type in which the recording head 2 is fixed, the number n of layers required of the ink discharge units 5 is determined by a desired dot interval dl during printing and the interval d2 between the recording electrodes 11 existing on one head substrate, and is expressed by d2=d1×n. How to pile up line heads of n layers is to pile up such that the recording electrodes 11 are arranged to be shifted in a zigzag shape, thereby it is arranged that dots can be printed with desired pitches in a direction perpendicular to the conveying direction of the recording medium. In an ink jet recording apparatus of a type in which printing is performed while the recording head 2 is moving, since the printing speed and the exactness are improved with a larger number n of layers, the number n of layers is determined by the specifications of the recording apparatus.

Figure 8:
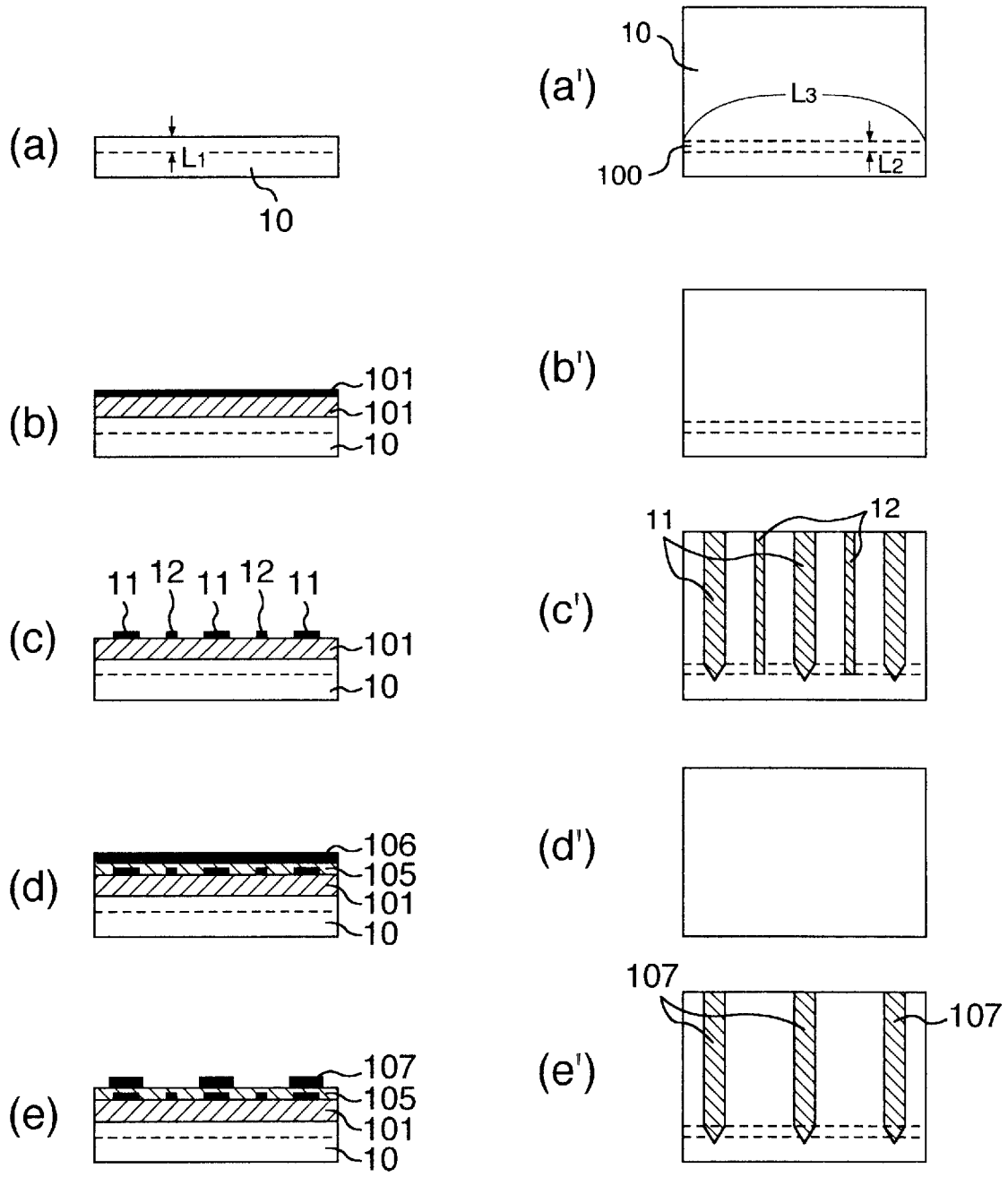
FIG. 8 is a view for explaining an example of a method for manufacturing the ink discharge unit in the recording head according to the present invention.
Figure 9:
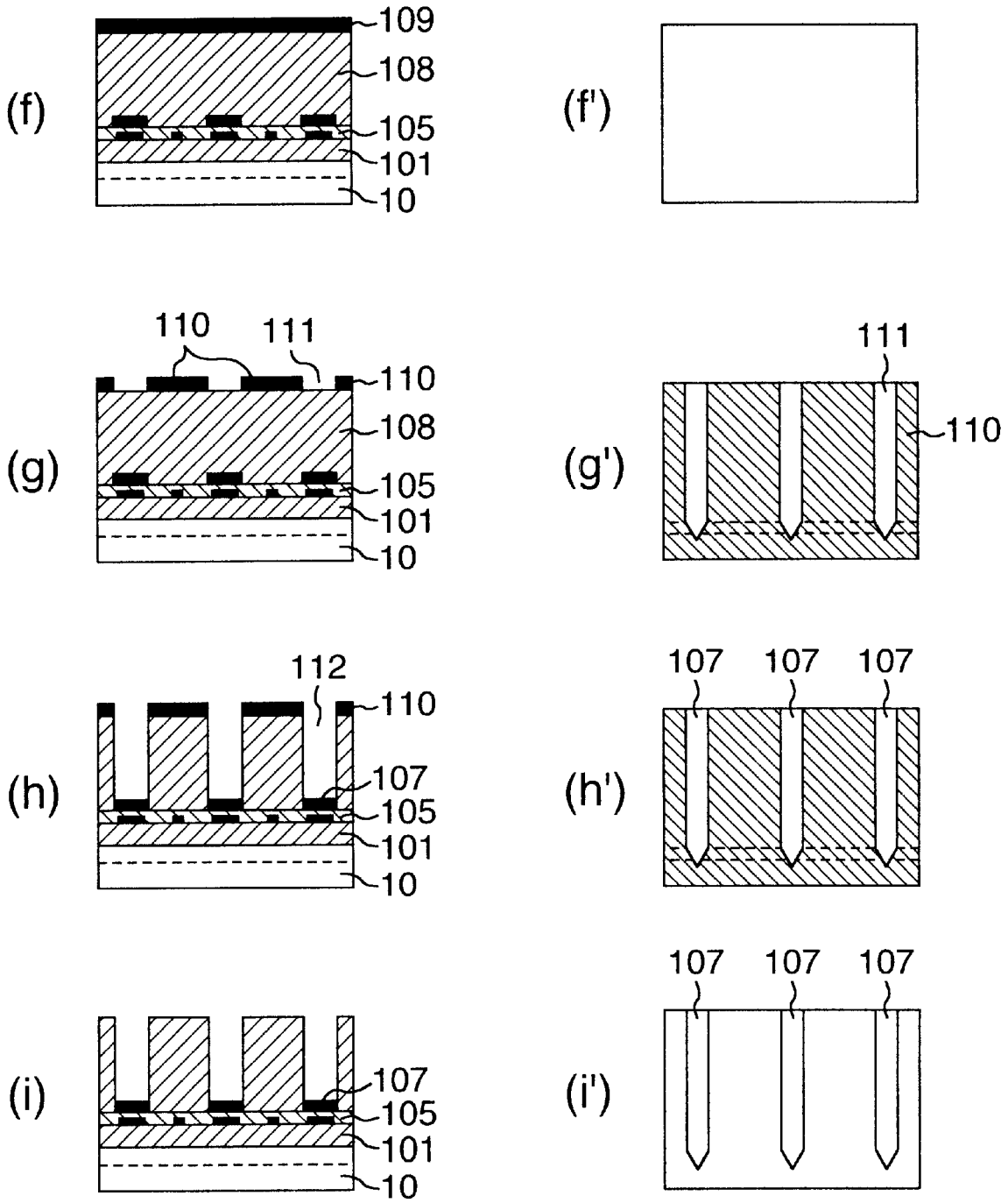
FIG. 9 is a view for explaining an example of a method for manufacturing the ink discharge unit in the recording head according to the present invention.
Figure 10:
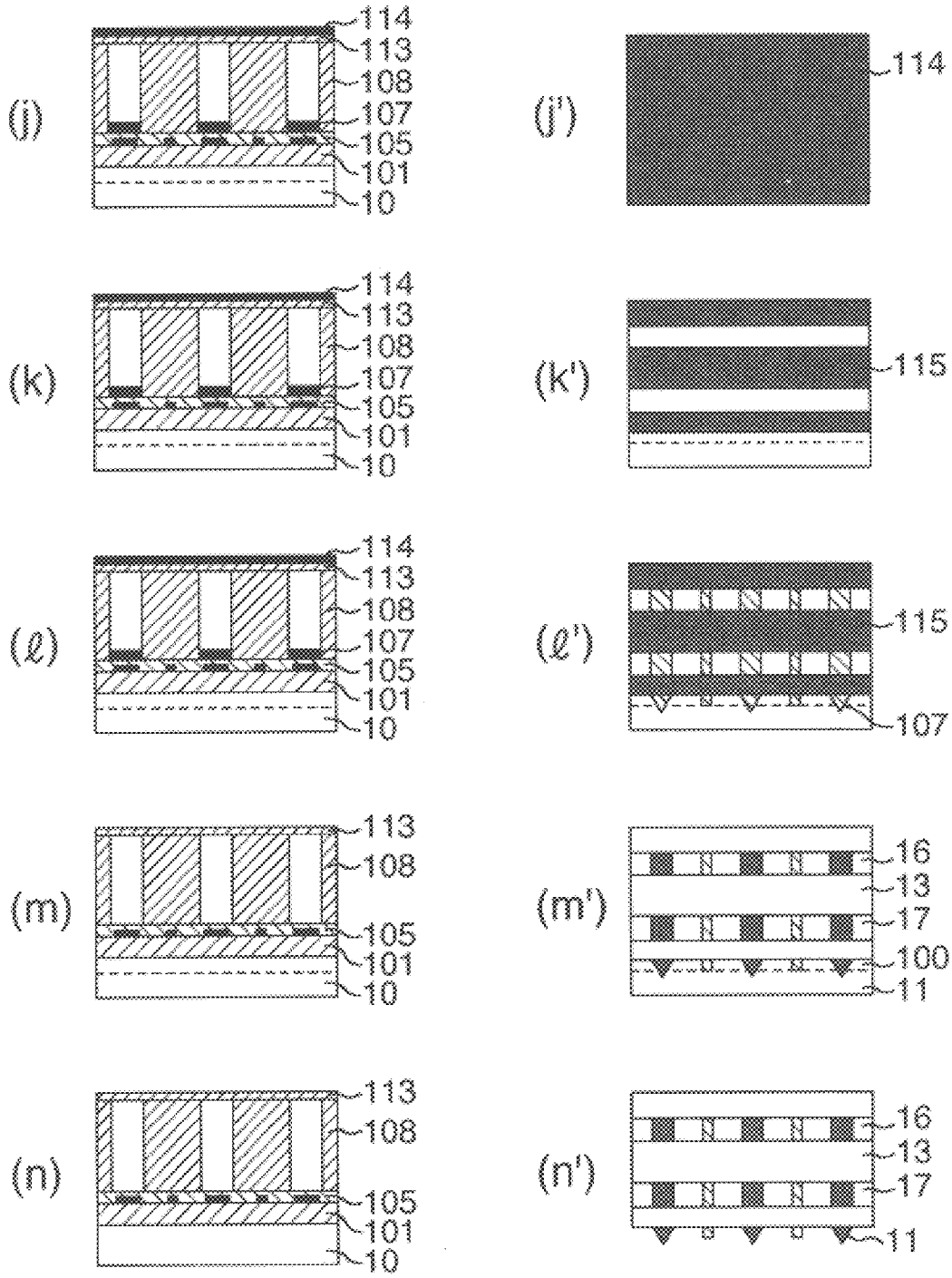
FIG. 10 is a view for explaining an example of a method for manufacturing the ink discharge unit in the recording head according to the present invention.

Next, with reference to FIGS. 8 to 10, the description will be made of an example of a method for manufacturing the recording head 2. A to N of the left-side views are views when the base side is viewed from the tip end side of the recording electrode 11, and the right-side views A' to N' are plan views.

In A and A', a head substrate 10 having thickness of about 1 mm such as glass is formed with a groove 100 by a dicing saw. This groove 100 may have width L2 of 0.2 to 0.5 mm and depth L1 of about 0.2 mm. However, its length L3 must be longer than the width to be used as the recording head 2.

In B and B', a polyimide sheet of the dielectric material 101 having thickness of about 20 μm is thermocompression bonded on the head substrate 10, on top of which metal film 102 of about 1 μm is formed as the film by the sputtering process or the like.

In C and C', the metal film 102 is coated with photoresist, and the photoresist layer is exposed to light through a photomask having a predetermined electrode pattern. Thus, a photoresist pattern is formed on the metal film 102 by development. The metal film 102 is etched using this photoresist pattern as a mask to thereby form the recording electrode 11 and the control electrode 12.

In D and D', it is coated with polyimide by spin coating, and thereafter, it is hardened to form a protective coat 105 having thickness of about 5 μm. Further, on top thereof, metal film 106 having thickness of about 1 μm is formed as the film by the sputtering process or the like.

In E and E', the metal film 106 is coated with photoresist, and the photoresist layer is exposed to light through a photomask having a predetermined electrode pattern. Thus, a photoresist pattern is formed on the metal film 106 by development. The metal film 106 is etched by using this photoresist pattern as a mask to thereby form a predetermined electrode pattern 107. This electrode pattern 107 is about 5 μm broader in width than the pattern of the recording electrode 11.

In F and F', a polyimide sheet, which is a dielectric layer 108 having thickness of 70 to about 100 μm, is thermocompression bonded on the electrode pattern 107, on top of which further metal film 109 having thickness of about 2 μm is formed as the film. For the metal film 109 here, metal film different from the metal film 106 is used. This is because selective etching will be needed in the after process in the present manufacturing method.

In G and G', next, a space portion 111 obtained by dissolving the metal film pattern 110 and the metal is formed by the same photolithography and etching as in the above described process.

In H and H', a space portion 112, which will serve as an ink flow path, is formed by dry etching the polyimide layer, which is the dielectric layer 108, with the metal patterns 110 and 107 as a mask.

In I and I', only the metal pattern 110 is removed by wet etching.

In J and J', a polyimide sheet 113 having thickness of about 20 μm is thermocompression bonded on the polyimide layer, which is the dielectric layer 108, further on top of which metal film 114 having thickness of about 1 μm is formed as the film. In this case, the metal film 114 may be the same one as the metal film 107.

In K and K', a metal pattern 115 is formed by the same photolithography and etching as in the above described process.

In L and L', the polyimide sheet 113 is dry etched with this metal pattern 115 as a mask.

In M and M', the electrode pattern 107 and the metal film 114 are removed by wet etching to thereby form an ink introducing port 16 and an ink recovery port 17.

In N and N', in accordance with the groove 100 on the surface of the head substrate 10, a groove is formed by a dicing saw from the rear surface thereof. Thus, the head substrate 10 is bent and divided at the bottom of the two grooves to polish the surface obtained by bending and dividing obliquely.

The above described process protrudes the tip end of the recording electrode 11 from the edge of the head substrate 10 by an appropriate amount. Finally, the head substrate 10 manufactured is, on the upper side thereof, mounted with a cover 19 with the ink flow path formed thereon. By this process, the ink discharge unit 5 according to the present embodiment is completed.

Since the ink flow paths and the plurality of recording electrodes can be uniformly manufactured in accordance with the configuration and the manufacturing method for the recording head according to the present invention as describe above, it is possible to provide stable circulation of the ink, and to make the magnitude of the electric fields at the tip ends of the recording electrodes uniform.

In this respect, a particularly long recording head can be simply manufactured at low cost according to the present manufacturing method.

In case of manufacturing the recording head of FIG. 11, if the head substrates 10 with the cover 19 are, at least between the adjacent upper and lower head substrates, laminated such that the positions of the recording electrodes 11 are shifted in a plane, a recording head capable of recording a highly precise image at high speed will be completed.

What is claimed is:

1. A recording head, comprising:

a first ink chamber and a second ink chamber, each containing ink comprising a coloring agent dispersed in solvent; and an ink discharge unit for discharging said ink, wherein said ink of said first and second ink chambers is circulated due to differences in height of ink levels in said first ink chamber and said second ink chamber, said first ink chamber, said ink discharge unit and said second ink chamber being separately arranged.

2. A recording head, comprising:

an ink discharge unit having a plurality of recording electrodes for discharging ink comprising a coloring agent dispersed in solvent;

a first ink chamber for containing said ink to be supplied to said ink discharge unit, arranged above said ink discharge unit; and a second ink chamber for containing said ink to be recovered from said ink discharge unit, arranged below said ink discharge unit, wherein said ink flows from said first ink chamber to said second ink chamber through said ink discharge unit due to differences in height of the positions whereat said first ink chamber, said ink discharge unit and said second ink chamber are arranged.

3. The recording head according to claim 2, further comprising ink flow rate adjusting units between said ink discharge unit and said first ink chamber, and between said ink discharge unit and said second ink chamber.

4. The recording head according to claim 3, wherein said ink flow rate adjusting unit is a magnet-valve.

5. The recording head according to claim 4, wherein said magnet-valve is closed during non-recording.

6. The recording head according to claim 4, wherein said magnet-valve has an amount of opening adjusting unit for adjusting an amount of opening of said magnet-valve.

7. The recording head according to claim 2, further comprising a pump for conveying said ink from said second ink chamber to said first ink chamber.

8. The recording head according to claim 7, further comprising a sensor for detecting an amount of said ink liquid within said second ink chamber.

9. The recording head according to claim 2, further comprising a replenish port for replenishing said ink to said second ink chamber.

10. The recording head according to claim 2, wherein ink flow paths are individualized only at the tip end portion of said recording electrode.

11. The recording head according to claim 2, wherein assuming a minimum value of the sectional area of an ink flow path upstream of said recording electrode to be Sa, the sectional area of an ink flow path at the tip end of said recording electrode to be Sb, and a minimum value of the sectional area of an ink flow path downstream of said recording electrode to be Sc, relation of $Sc>Sa>Sb$ is satisfied.

12. The recording head according to claim 2, wherein there is provided an absorbing member for absorbing said ink below said recording electrode.

13. The recording head according to claim 2, further comprising a migration electrode at a starting position where said ink is recovered from the tip end of said recording electrode.

14. The recording head according to claim 13, further comprising a voltage applying unit for applying, during printing, voltage so as to gather the coloring agent in said ink from said migration electrode toward said recording electrode, and for applying, during non-printing, voltage so as to gather the coloring agent in said ink from said recording electrode toward said migration electrode at predetermined intervals.

15. An ink jet recording apparatus, comprising:

an ink jet recording method having an ink discharge unit provided with a plurality of recording electrodes for discharging ink comprising a coloring agent dispersed in solvent;

a recording head having a first ink chamber for supplying said ink to said ink discharge unit, arranged above said ink discharge unit, and a second ink chamber for recovering said ink from said ink discharge unit, arranged below said ink discharge unit;

a common electrode arranged at a position opposite to said recording electrode; and a conveying mechanism for conveying a recording medium between said recording head and said common electrode, wherein, in said recording head, said ink flows from said first ink chamber to said second ink chamber through said ink discharge unit due to differences in height of the positions whereat said first ink chamber, said ink discharge unit and said second ink chamber are arranged.

* * * * *